United States Patent [19]

Ambrose

[11] 4,199,962

[45] Apr. 29, 1980

[54] MULTIPLE-SIZED RING

[75] Inventor: Robert L. Ambrose, New York, N.Y.

[73] Assignee: Anthony H. Handal, New York, N.Y. ; a part interest

[21] Appl. No.: 928,605

[22] Filed: Jul. 27, 1978

[51] Int. Cl.[2] ..... A44C 9/00; A44C 9/02

[52] U.S. Cl. ..... 63/15; 63/15.5

[58] Field of Search ..... 63/15, 15.5; D11/26

[56] References Cited

U.S. PATENT DOCUMENTS

| | | | |
|---|---|---|---|
| D. 225,442 | 12/1972 | Stein | D11/26 |
| 1,018,875 | 2/1912 | Cardon | 63/15 |
| 1,950,526 | 3/1934 | Stetter | 63/15.5 |

OTHER PUBLICATIONS

Deutsche Goldschmiede Zeitung–Issue of Jul. 1959, No. 7/1959, p. 367 only relied on.

*Primary Examiner*—F. Barry Shay
*Attorney, Agent, or Firm*—Anthony H. Handal

[57] ABSTRACT

A ring comprising a metal body which defines a plurality of finger passages is disclosed. Each of the passages is defined between a pair of orifices located peripherally on the body with an orifice being shared by two passages of different size.

8 Claims, 9 Drawing Figures

MULTIPLE-SIZED RING

BACKGROUND OF THE INVENTION

Over the years a great many rings and attachments for rings have been designed which allow a single ring to be adapted for wear on fingers of different size. Such rings and attachments are of particular use in situations where the wearer suffers from a temporary gain or loss of weight, or has acquired the ring and for sentimental or other reasons does not desire to change the size.

Perhaps the commonest solution to this problem is the conventional ring guard which is simply a strip of metal having bendable gripping members at its extremities. In use, such ring guards are placed inside the ring and bent in such a manner that the strip, together with a portion of the ring, defines a passage of desired ring size for receiving the wearer's finger. The gripping members are then bent around the shank and secured to it in this manner.

However, such an adjustable ring has a number of disadvantages. For example, the ring is uncomfortable and the guard tends to wear and fatigue with use. It is also usually not possible or practical to make the guard out of the same precious metal as the ring. Accordingly, with the passage of time, the guard's gold plating or other precious covering tends to corrode away or become worn.

A different solution to the same problem is illustrated by U.S. Pat. No. 3,423,956 to Manne. In accordance with this patent, the disclosed ring includes a pair of pivotally-mounted shank elements. One of the shank elements has a tube at its end while the other shank element has a rod at its end. The rod is inserted into the tube and the pivotally-mounted shank elements are rotated inserting the rod into the tube a desired distance and thus varying the size of the ring. However, this ring includes springs and other elements which cannot be made of precious metal, giving rise to corrosion problems.

Still another approach to this problem is disclosed in U.S. Pat. No. 3,017,754 to Manne et al. In accordance with this patent, a ring shank is comprised of a number of elements which are interlinked together and thus form a separable shank of variable size. However, the construction of this ring is complicated and its durability accordingly suffers. Moreover, the ring is, because of the configuration of its parts, relatively expensive to manufacture.

In accordance with the present invention, the above-mentioned disadvantages of prior art multiple-sized rings are obviated. The design of the ring is very classic in appearance and its construction may be accomplished with conventional ring-making equipment. Its construction may be all in precious metal or in a less precious material such as plastic or the like. Its mechanical construction lends it durability and beauty of appearance.

SUMMARY OF THE INVENTION

A finger ring is disclosed which comprises a body defining a first passage extending between first and second orifices. A second passage extends between the second orifice and a third orifice. The third orifice is smaller than the second orifice and the second passage is smaller than the first passage.

DETAILED DESCRIPTION OF THE PREFERRED EMBODIMENT

Figure 1:
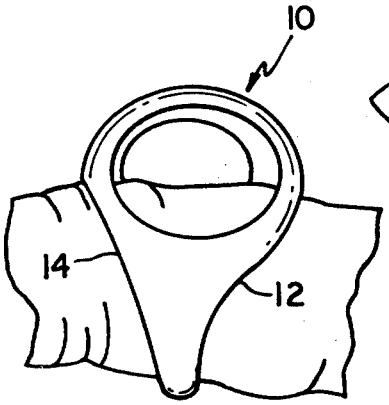
FIG. 1 is a perspective view of the inventive ring on a relatively large finger.
Figure 2:
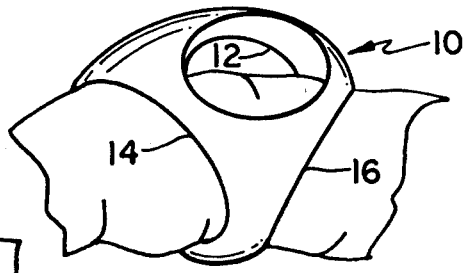
FIG. 2 is a perspective view of the inventive ring on an average-sized finger.
Figure 3:
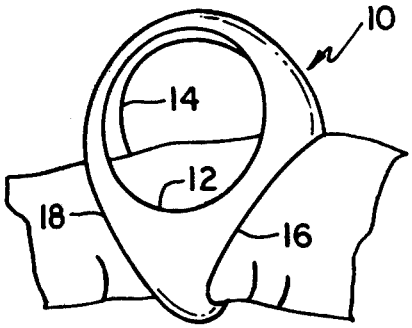
FIG. 3 is a perspective view of the inventive ring illustrated in FIGS. 1 and 2 on a small finger.
Figure 4:
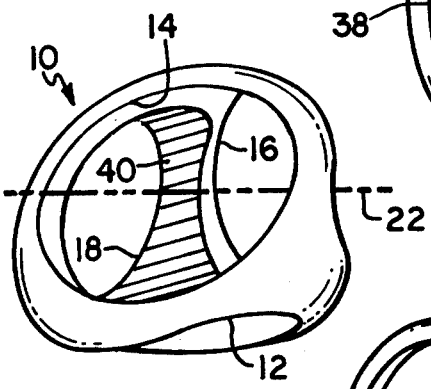
FIG. 4 is a front perspective view of the inventive ring illustrating the passages of different size.
Figure 5:
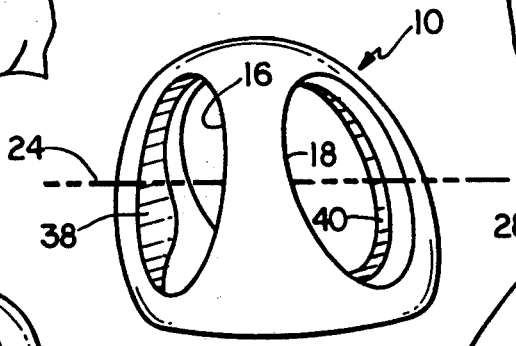
FIG. 5 is a rear perspective view of the inventive ring illustrating the passages of different size.
Figure 6:
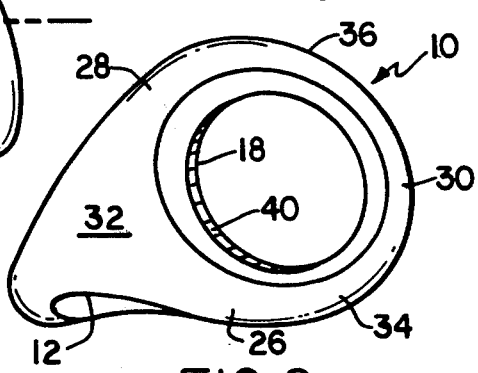
FIG. 6 is a right perspective view of the inventive ring illustrating the passages of different size.
Figure 7:
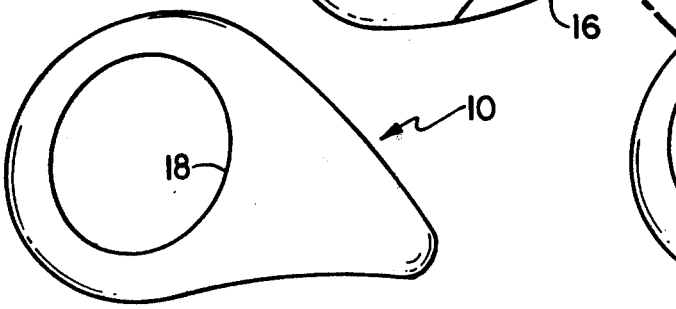
FIG. 7 is a left perspective view of the inventive ring illustrating the passages of different size.
Figure 8:
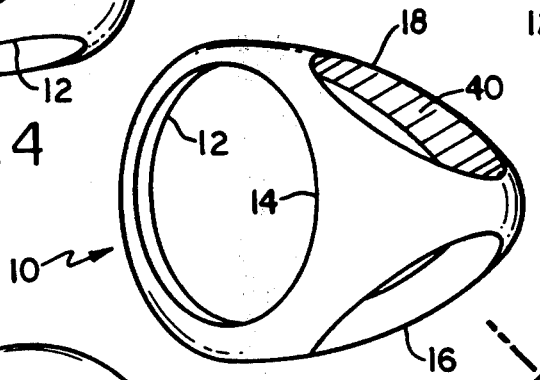
FIG. 8 is a top perspective view of the inventive ring illustrating the passages of different size.

In FIGS. 1–3, the inventive ring is shown on fingers of large, average and small size, respectively. Referring to FIGS. 4–9, the inventive ring 10 comprises a first large orifice 12, a second large orifice 14, a medium-sized orifice 16 and a small orifice 18. These orifices are located peripherally on the ring body and are substantially the entrances to a large passage, a small passage and an average-sized passage. The three passages are roughly, in accordance with the preferred embodiment, sections of cylinders and cones defined between planes within which the orifices lie.

Figure 9:
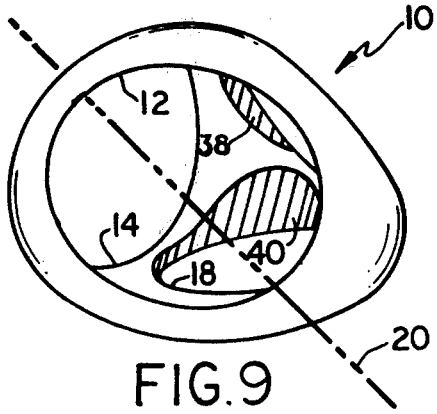
FIG. 9 is a bottom perspective view of the inventive ring illustrating the passages of different size.

In particular, the large passage, whose central axis is indicated in FIG. 9 by line 20, is defined between large orifices 12 and 14. A medium-sized passage, whose central axis is indicated by line 22, is defined by large orifice 14 and medium-sized orifice 16. Finally, a small passage, whose central axis is indicated by line 24, is defined between small orifice 18 and medium-sized orifice 16.

Orifice 16 is defined by three shank portions 26, 28 and 30 which join together three face portions 32, 34 and 36. Face portions 32 and 34 are thus joined by shank portion 26, face portions 34 and 36 are joined together by shank portion 30 and face portions 36 and 32 are joined by shank portion 28.

In the area just inside orifice 16 the passage of medium-size is defined by the inside metal surfaces of the ring, and in particular by the inside surfaces 38 of shank portions 26 and 28 and face portions 32 and 36, which inside surfaces generally follow the form of a cylinder having a diameter substantially equal to the inside diameter of a ring sized for a finger whose size is ideal for the medium size of the ring. This cylinder has the same central axis as the medium-sized passage, the central axis substantially including the center of medium-sized orifice 22 and the center of large orifice 14.

Thus, medium-sized orifice 16 aims at large orifice 14 and has a comfortable surface to support the finger when the finger is using the medium-sized passage as illustrated in FIG. 2. While large orifice 14 is not aimed at medium-sized orifice 11, its orientation at an angle with respect to the axis defined by line 22 and its relatively large size work together to distribute pressure evenly and comfortably on the finger of the wearer. This is because of the fact that the projection of orifice 14 in the plane defined by orifice 16 conforms fairly closely to orifice 16.

In a similar manner, passage 24 in the area adjacent small orifice 18 is defined by the inside surfaces 40 of the shank portions and face portions that define small orifice 18 as a generally cylindrical shape having a central axis which coincides with the central axis of passage 24. Small orifice 18 thus aims at medium-sized orifice 16 and together with medium-sized orifice 16 forms a small passage for use of the ring on a relatively small finger.

When it is desired to use the inventive ring on a relatively large finger, the finger is first inserted into large orifice 14, through the ring and out through large orifice 12, as is illustrated in FIG. 1. If the inventive ring is to be used on a finger of average size, the finger is inserted into large orifice 14 and passes through the ring until it exits through medium-sized orifice 16, as is illustrated in FIG. 2. Likewise, if it is desired to use the inventive ring on a relatively small finger, the small finger enters the ring through medium-sized orifice 16, and then passes through the ring and exits the ring through small orifice 18 as is illustrated in FIG. 3.

While an illustrative embodiment of the invention has been described, it is, or course, understood that various modifications of the invention will be obvious to those of ordinary skill in the art. Such modifications are within the spirit and scope of the invention which is limited and defined only by the appended claims.

What I claim is:

1. A finger ring comprising a body having inside surfaces substantially defining:

(a) a first finger passage extending between first and second orifices;

(b) a second finger passage distinct and separate from said first passage, extending between said second orifice and a third orifice; and (c) a third finger passage distinct and separate from said first and second passages, said third passage extending between said third orifice and a fourth orifice, each of said passages being of a different size than the other passages and said passages having axes which are non-coplanar.

2. A finger ring as in claim 1, wherein said first passage is larger than said second passage and said third passage is smaller than said second passage.

3. A finger ring as in claim 1, wherein said second passage in the area adjacent said third orifice aims toward said second orifice, and said third passage in the area adjacent said fourth orifice aims toward said third orifice.

4. A finger ring, comprising a body defining a first finger passage extending between first and second orifices; a second finger passage extending between said second orifice and a third orifice; and a third finger passage extending between said third orifice and a fourth orifice, said first orifice being defined by three faces, each of said faces being joined by shanks to each of the other two faces of said three faces to define said first orifice, a remaining portion of each of said faces extending toward a fourth face and each joined by a shank to said fourth face, said fourth face together with said shanks and said three faces forming said second, third and fourth orifices.

5. A finger ring as in claim 4, wherein said faces and shanks are positioned, configured and dimensioned to define each of said second and third passages with four shanks, at least two of said shanks having inside surfaces that substantially coincide with and define the outer limits of each of said second and third passages.

6. A finger ring comprising a body defining:

(a) a first finger passage extending between first and second orifices; and (b) a second finger passage distinct from said first passage, said second finger passage extending between said second orifice and a third orifice, said third orifice being smaller than said second orifice and said second passage being smaller than said first passage, said first, second and third orifices being positioned peripherally on said body.

7. A finger ring as in claim 6, wherein said first and second orifices are of substantially the same size.

8. A finger ring as in claim 6, wherein said second passage in the area adjacent said third orifice aims toward said second orifice.

* * * * *